US009574389B2

(12) United States Patent
Menze et al.

(10) Patent No.: US 9,574,389 B2
(45) Date of Patent: Feb. 21, 2017

(54) LINE BELT DRIVEN RETROFITTABLE DOOR OPENER, SYSTEM, AND METHOD OF RETROFITTING THEREOF

(71) Applicant: Eon Enterprises LLC, Cornelius, NC (US)

(72) Inventors: Peter C. Menze, Marquett, MI (US); Stephen R. Lang, Ishpeming, MI (US); Matthew P. Jewell, Gwinn, MI (US)

(73) Assignee: Eon Enterprises LLC, Cornelius, NC (US)

( * ) Notice: Subject to any disclaimer, the term of this patent is extended or adjusted under 35 U.S.C. 154(b) by 0 days.

(21) Appl. No.: 14/739,381

(22) Filed: Jun. 15, 2015

(65) Prior Publication Data

US 2016/0362928 A1 Dec. 15, 2016

(51) Int. Cl.

| | |
|---|---|
| ***E05F 15/75*** | (2015.01) |
| ***E05F 15/63*** | (2015.01) |
| ***E05F 15/627*** | (2015.01) |
| ***E05B 1/00*** | (2006.01) |
| ***E05C 21/00*** | (2006.01) |

(52) U.S. Cl.

CPC ..... *E05F 15/75* (2015.01); *E05B 1/0053* (2013.01); *E05C 21/00* (2013.01); *E05F 15/627* (2015.01); *E05F 15/63* (2015.01); *E05Y 2800/70* (2013.01); *E05Y 2900/132* (2013.01)

(58) Field of Classification Search

CPC ..... E05F 15/75; E05F 15/675; E05F 15/63; E05C 21/00; E05B 1/0053

USPC ..... 49/339, 340, 341, 345

See application file for complete search history.

(56) References Cited

U.S. PATENT DOCUMENTS

| | | | | |
|---|---|---|---|---|
| 3,114,541 | A | 12/1963 | Coffey | |
| 3,284,950 | A | 11/1966 | Gute | |
| 4,658,545 | A | 4/1987 | Ingham et al. | |
| 5,878,530 | A * | 3/1999 | Eccleston | E05F 15/79 49/139 |
| 6,002,217 | A | 12/1999 | Stevens et al. | |
| 6,108,975 | A * | 8/2000 | Bailey | E05F 15/63 49/334 |
| 6,588,153 | B1 * | 7/2003 | Kowalczyk | E05F 15/603 49/280 |
| 6,634,140 | B1 | 10/2003 | Sellman | |
| 7,316,096 | B2 * | 1/2008 | Houser | E05F 15/63 49/139 |
| 7,484,333 | B2 | 2/2009 | Houser et al. | |
| 8,109,038 | B2 | 2/2012 | Houser et al. | |
| 8,169,317 | B2 | 5/2012 | Lemerand et al. | |
| 8,365,469 | B2 | 2/2013 | Kowalczyk et al. | |
| 8,390,219 | B2 * | 3/2013 | Houser | E05F 15/70 318/255 |

(Continued)

*Primary Examiner* — Jerry Redman

(74) *Attorney, Agent, or Firm* — Jeffrey C. Watson; Grell & Watson Patent Attorneys

(57) ABSTRACT

A line belt driven retrofittable door opener includes a motor, a drive link, an output link, and at least one flexible link. The at least one flexible link includes at least one flexible line link. The drive link is connected to the motor. The output link is connected to the arm of the door. The at least one flexible link interconnects the drive link with the output link. Wherein, the motor is configured for opening the door by rotating the drive link, which in turn rotates the output link via the at least one flexible link, which in turn rotates the arm, thereby opening the door.

25 Claims, 8 Drawing Sheets

(56) References Cited

U.S. PATENT DOCUMENTS

| | | | | |
|---|---|---|---|---|
| 8,407,937 | B2 * | 4/2013 | Houser | E05F 15/63 49/139 |
| 8,499,495 | B2 | 8/2013 | Houser et al. | |
| 8,547,046 | B2 * | 10/2013 | Burris | E05F 3/227 16/49 |
| 8,653,982 | B2 * | 2/2014 | Yulkowski | E05F 15/40 340/540 |
| 8,773,237 | B2 * | 7/2014 | Burris | E05F 3/227 16/49 |
| 9,115,526 | B2 * | 8/2015 | Houser | E05F 3/227 |
| 9,133,663 | B2 * | 9/2015 | Klish | E06B 9/82 |
| 2005/0073425 | A1 * | 4/2005 | Snell | E05F 15/00 340/686.6 |
| 2005/0091928 | A1 * | 5/2005 | Okulov | E05F 15/74 49/341 |
| 2008/0115543 | A1 * | 5/2008 | Lanigan | E05B 47/0046 70/57.1 |
| 2009/0139141 | A1 | 6/2009 | MacLeod et al. | |
| 2009/0265992 | A1 * | 10/2009 | Hass | E05F 15/63 49/340 |
| 2010/0115853 | A1 * | 5/2010 | Gebhart | H02P 6/085 49/506 |

* cited by examiner

LINE BELT DRIVEN RETROFITTABLE DOOR OPENER, SYSTEM, AND METHOD OF RETROFITTING THEREOF

CROSS-REFERENCE TO RELATED APPLICATIONS

None

FEDERALLY SPONSORED RESEARCH OR DEVELOPMENT

None

PARTIES TO A JOINT RESEARCH AGREEMENT

None

REFERENCE TO A SEQUENCE LISTING

None

BACKGROUND OF THE DISCLOSURE

Technical Field of the Disclosure

The instant disclosure relates to door operating systems. More particularly, the instant disclosure relates to a line belt driven retrofittable door opener, system, and method of retrofitting thereof.

Description of the Related Art

Opening, closing, and passing through doors can be a challenge for elderly people or individuals with disability. For example, those who are physically challenged and need to use either wheelchair, scooter, cane or walker have difficulty transitioning through doorways. As such, there is clearly a need for some type of door control to assist them with doors. Currently, there are different modifications that could be made to the existing doors to meet this need and give this population more physical independence.

One solution is automatic door openers or door opener systems. These systems are typically an electronic and/or pneumatic device that can be installed on the existing doors for office or home use to automatically operate them. The instant disclosure is mainly directed to swing doors, but similar systems could be designed for sliding doors as well. Automatic door openers can be sensor automatic door openers, touch-type automatic door openers that use a wall mounted switch or panel that automatically opens the door, and/or remote control automatic door systems.

One thing that has been discovered with current door opener systems is that with the constant passage of people through the doorway, like through public doorways of office buildings, the gears, shafts, and motor assembly which are normally part of the automatic door opener, becomes worn over time. With the current automatic systems, although they are not used that frequently by a Handicapped person, they are operated every time a person manually opens the door. In addition, when the system is engaged and opening a door, the rigid gears, shafts and motor assemblies can easily be stripped or broken upon someone accidentally bumping the door or forcing the door in the opposite direction. Thus, even though they may not even be utilized often, wear and tear on these systems may be quite high.

Another problem that has been discovered with current door opener systems is that they necessitate a greater door-opening force than normally required, as the currant door opener systems all have friction or drag of some type. The opening force for doors is required to be less than 5.0 pounds (22.2 N) maximum force required to activate all parts but the door must still be able to close and deal with winds that blow the door open so losing even adding a small amount of drag takes away from the force needed to close and control the door.

Another problem that has been discovered is that most doors include a standard door closer already installed. The standard closer is well known as a door closing mechanism that has a Body (Steel or Aluminum) with a spring used as a force to rotate a rotating pinion that attaches to the door arm that pushes or pulls a door close. For example, the speed of the door is usually controlled by oil passing threw a valve. The closer also has a pinion shaft that passes threw the body. The LCN 4040 and Norton are typical types. As such, in order to install a door opener system, with the current door opener systems, one must work around the existing door closer and/or remove it all together.

Therefore, it is readily apparent that there is a recognizable unmet need for a door opener and system that is flexible, that necessitates little to no additional opening force, and may be retrofittable to existing doors and their closers. The instant disclosure is designed to address at least some of the above mentioned problems by providing a line belt driven retrofittable door opener.

SUMMARY

Briefly described, in a preferred embodiment, the present apparatus, system, and method overcomes the above-mentioned disadvantages and meets the recognized need for such a device by providing a line belt driven retrofittable door opener, system, and method of retrofitting thereof.

The present apparatus, system, and method may include a door opener that may be for automatically opening a door with an arm. The door opener may include a motor, a drive link, an output link, and at least one flexible link, like a flexible line link. The drive link may be connected to the motor. The output link may be connected to the arm of the door. The at least one flexible link may interconnect the drive link with the output link. In select embodiments, the at least one flexible link may include a flexible line link. Wherein, the motor may be configured for opening the door by rotating the drive link, which in turn may rotate the output link via the at least one flexible link, which in turn may rotate the arm, thereby opening the door.

One feature may be that the at least one flexible link can include a rubber belt, a urethane belt, a flexible steel belt, a rope, a chain, the like, and/or any other flexible link material or device. In one embodiment, the at least one flexible link can include at least one flexible line link. The at least one flexible line link may be configured to compress and/or stretch to create a shock absorbing action, to allow manual opening of the door, and/or to allow manual opening of the door without rotating the motor.

In select embodiments, the at least one flexible link may include a loop belt and a line belt. In these embodiments, the system may further include a differential pulley interconnecting the loop belt with the line belt. Wherein, the drive link may be a drive pulley and the output link may be an output pulley. In select embodiments, the loop belt may be looped around the drive pulley connected to the motor and a first wheel of the differential pulley. The line belt may be wound around the output pulley at one end and wound around a second wheel of the differential pulley at its other end. In one embodiment, the first wheel and the second wheel of the differential pulley may be rotationally fixed. In these embodiments, the motor may be configured for opening the door by rotating the drive pulley, which in turn may rotate the differential pulley via the loop belt, which in turn may rotate the output pulley via the line belt, which in turn may rotate the arm, thereby opening the door.

One feature of the door opener may be that the line belt may be configured to allow manual opening of the door without rotating the motor. In one embodiment, when the door is manually opened and the arm rotates the output pulley, the line belt may be configured to uncoil.

In select embodiments, the line belt may include an anti-stick material between wound layers configured for preventing the wound layers from sticking.

In select embodiments, the inner surface of the loop belt may include teeth configured to grip grooves on the drive pulley and the first wheel of the differential pulley.

In select embodiments, the drive pulley may be smaller than the output pulley, the drive pulley may be smaller than the first wheel of the differential pulley, the first wheel of the differential pulley may be larger than the second wheel of the differential pulley, and/or the second wheel of the differential pulley may be smaller than the output pulley.

Another feature of the door opener may be the inclusion of a back plate and/or inner bracket. The back plate may be configured for mounting the door opener system to the door. The inner bracket assembly may be configured to house the door opener and at least position the motor, the drive link and the output link.

Another feature of the door opener may be that it can be configured to be retrofitted to an existing door closer. In select embodiments, retrofitted, may refer herein, to the capability of adding the door opener to the existing door closer without having to modify the existing door closer. As such, in select embodiments, no holes need to be made or drilled, no change to the internals or mechanics of the existing door closer need to be made (i.e. power settings, etc.), the like, and/or combinations thereof. In select embodiments, the output link may be configured to attach with the rotating pinion of the existing door closer. Whereby, the door opener may open the door by rotating the output link, which in turn may rotate the rotating pinion of the existing door closer, which in turn may rotate the arm, thereby opening the door. When the door is opened, the existing door closer may control the closing of the door via the rotating pinion.

In select embodiments wherein the existing door closer is non-handed via the rotating pinion extending through the existing door closer on both ends, when the existing door closer is mounted on the door with the arm connected to one end of the rotating pinion, the output pulley of the door opener may be configured to attach to the unused end of the rotating pinion.

In one embodiment, the door opener may be for automatically opening a door with an arm and an existing door closer linked to the arm via a rotating pinion. In this embodiment, the door opener may include the motor with the output link connected to the arm of the door via the rotating pinion. As such, the output link may be configured to attach with the rotating pinion of the existing door closer.

The door opener system may be for automatically opening and controlling the closing of a door with an arm. The door opener system may include the door opener and a door closer, like an existing door closer. The door opener may include the motor connected with the output link. The door closer may include the rotating pinion. Wherein, the output link of the door opener may be attached with the rotating pinion of the door closer.

In use, a method of retrofitting a door opener to an existing door closer with a rotating pinion may be carried out utilizing any of the various embodiments of the door opener as shown and/or described herein. In select embodiments, the method of retrofitting a door opener to an existing door closer with a rotating pinion may generally include the steps of: providing a door opener in any of the various embodiments shown and/or described herein; and attaching the output link of the door opener with the rotating pinion of the existing door closer.

In select embodiments of the method of retrofitting a door opener to an existing door closer, wherein the existing door closer is non-handed via the rotating pinion extending through the existing door closer on both ends, the step of attaching the output link of the door opener with the rotating pinion of the existing door closer may include attaching the output link of the door opener to the unused end of the rotating pinion of the existing door closer.

In other select embodiments of the method of retrofitting a door opener to an existing door closer, the method may further include the steps of: removing the existing door closer; mounting the existing door closer and door opener to a back plate; and connecting the back plate to the door.

In other select embodiments of the method of retrofitting a door opener to an existing door closer, the method may include a process of retrofitting without having to modify the existing door closer. As such, in select embodiments, no holes need to be made or drilled, no change to the internals or mechanics of the existing door closer need to be made (i.e. power settings, etc.), the like, and/or combinations thereof.

These and other features of the line belt driven retrofittable door opener system and method of retrofitting thereof will become more apparent to one skilled in the art from the prior Summary, and following Brief Description of the Drawings, Detailed Description, and Claims when read in light of the accompanying Detailed Drawings.

BRIEF DESCRIPTION OF THE DRAWINGS

The present line belt driven retrofittable door opener, system, and method of retrofitting thereof will be better understood by reading the Detailed Description with reference to the accompanying drawings, which are not necessarily drawn to scale, and in which like reference numerals denote similar structure and refer to like elements throughout, and in which.

Figure 1:
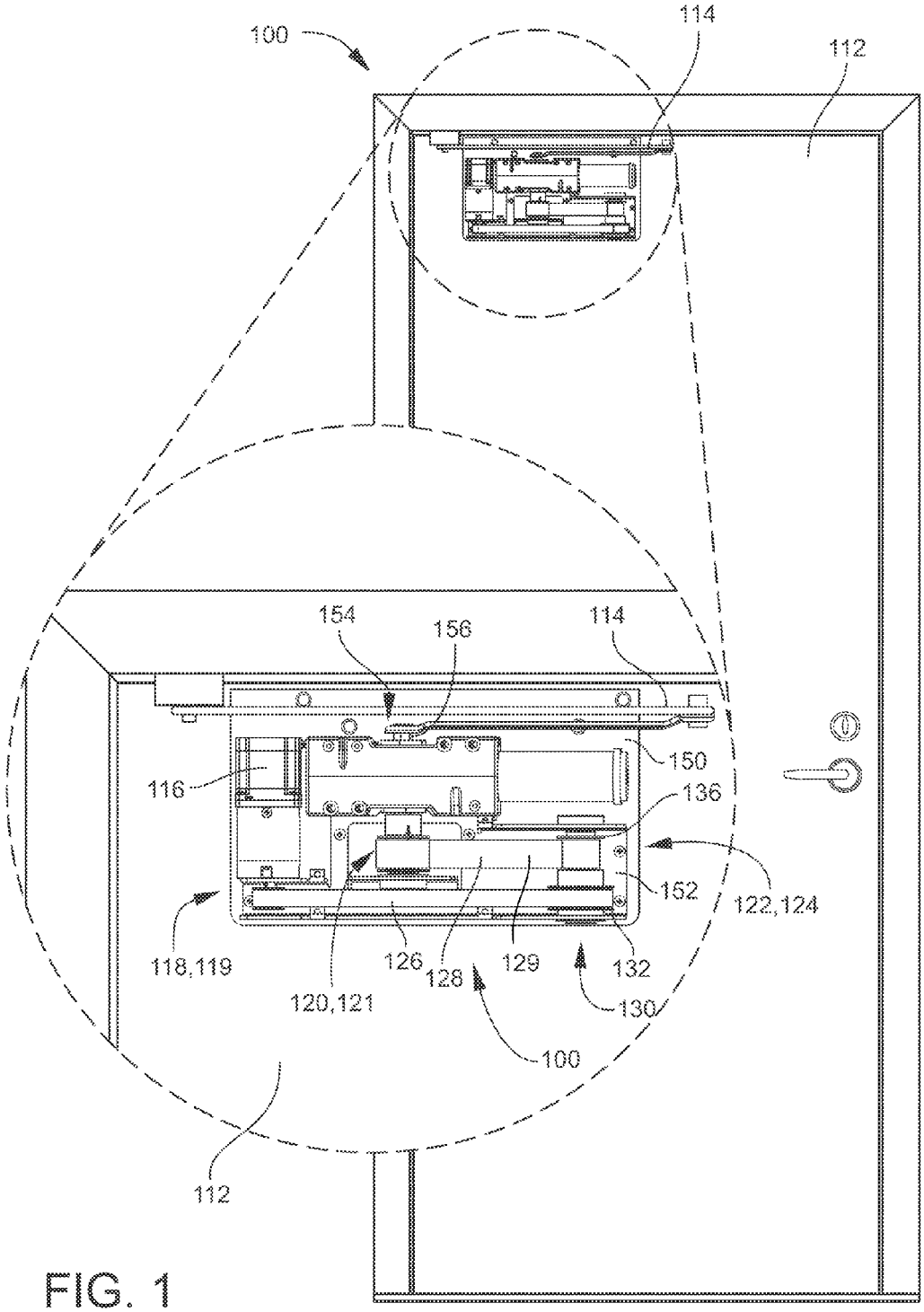
FIG. 1 is a front plan view of the door opener system according to select embodiment of the instant disclosure installed on a door with an arm with a zoomed in view of the door opener system.
Figure 2:
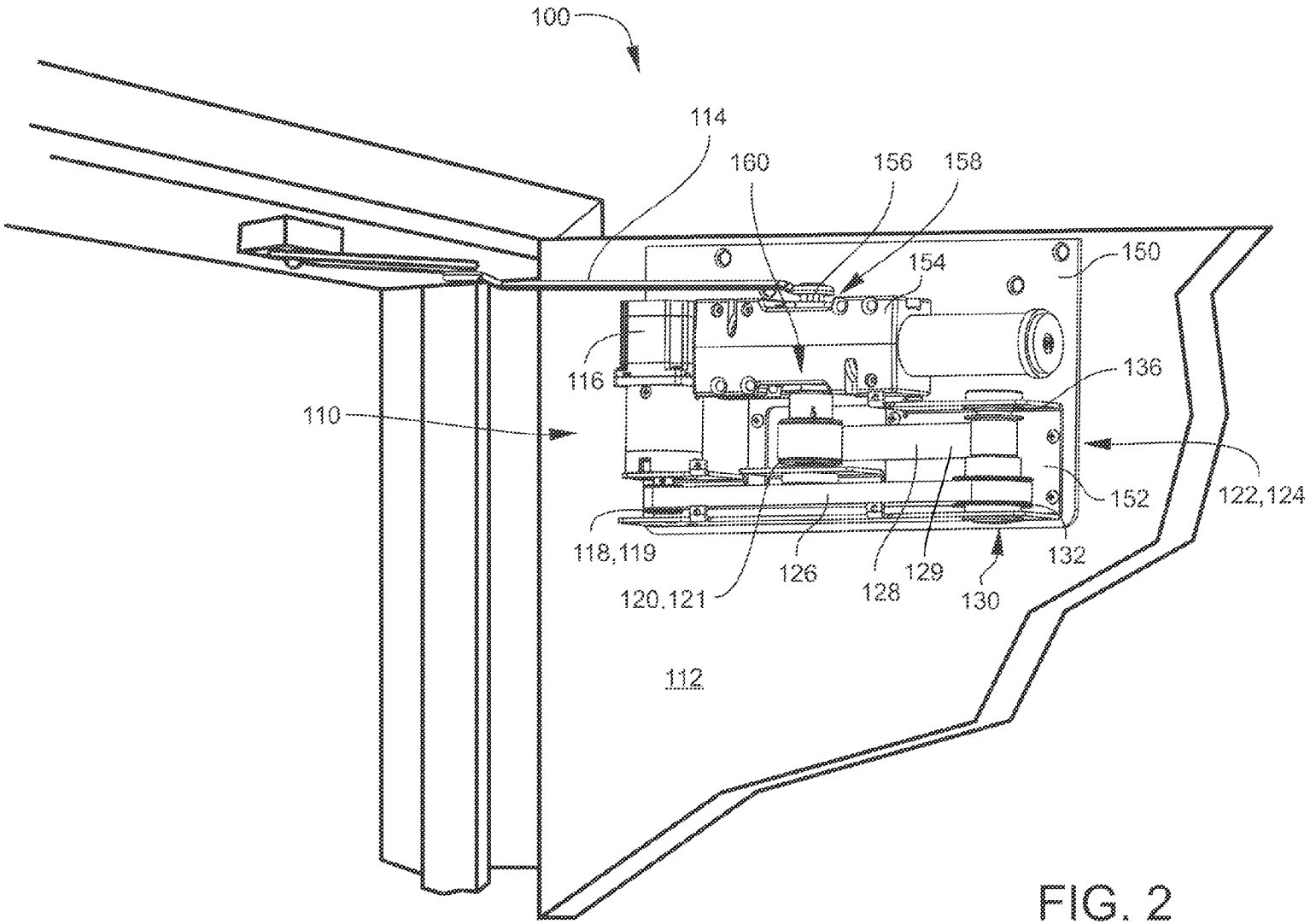
FIG. 2 is a partial perspective view of the door opener system of FIG. 1 with the door open.
Figure 3:
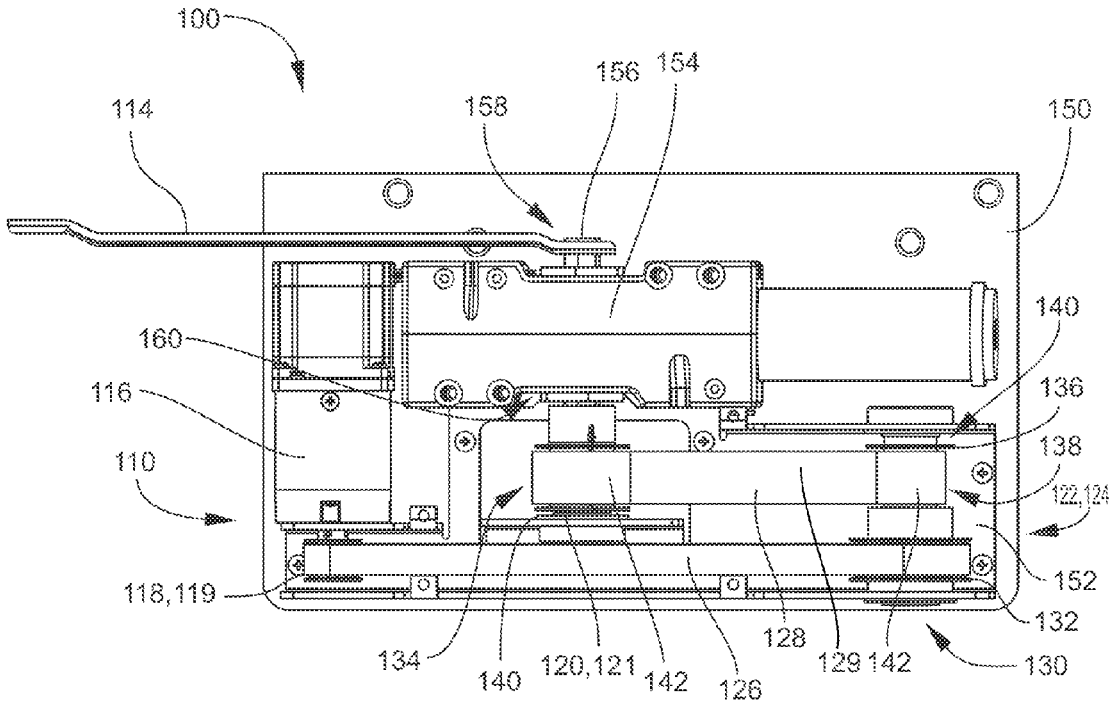
FIG. 3 is a front view of the door opener system of FIG. 1.
Figure 4:
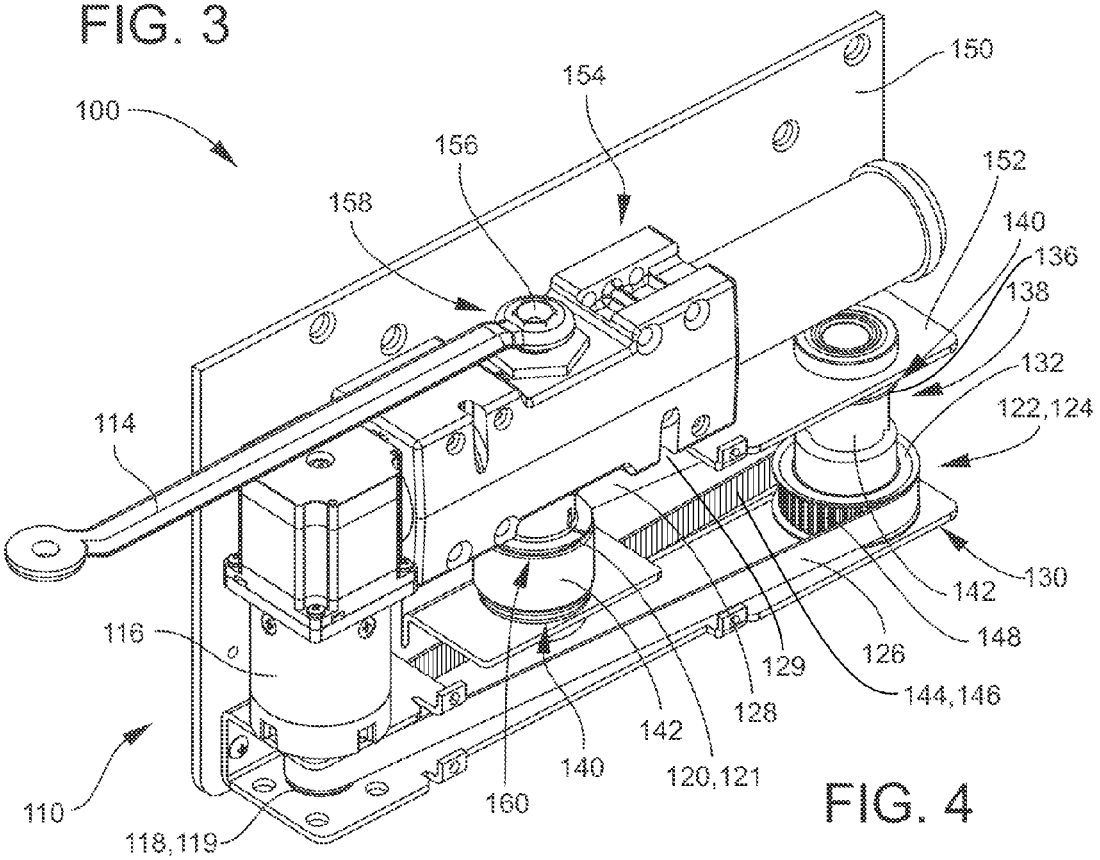
FIG. 4 is a front perspective view of the door opener system of FIG. 1.
Figure 5:
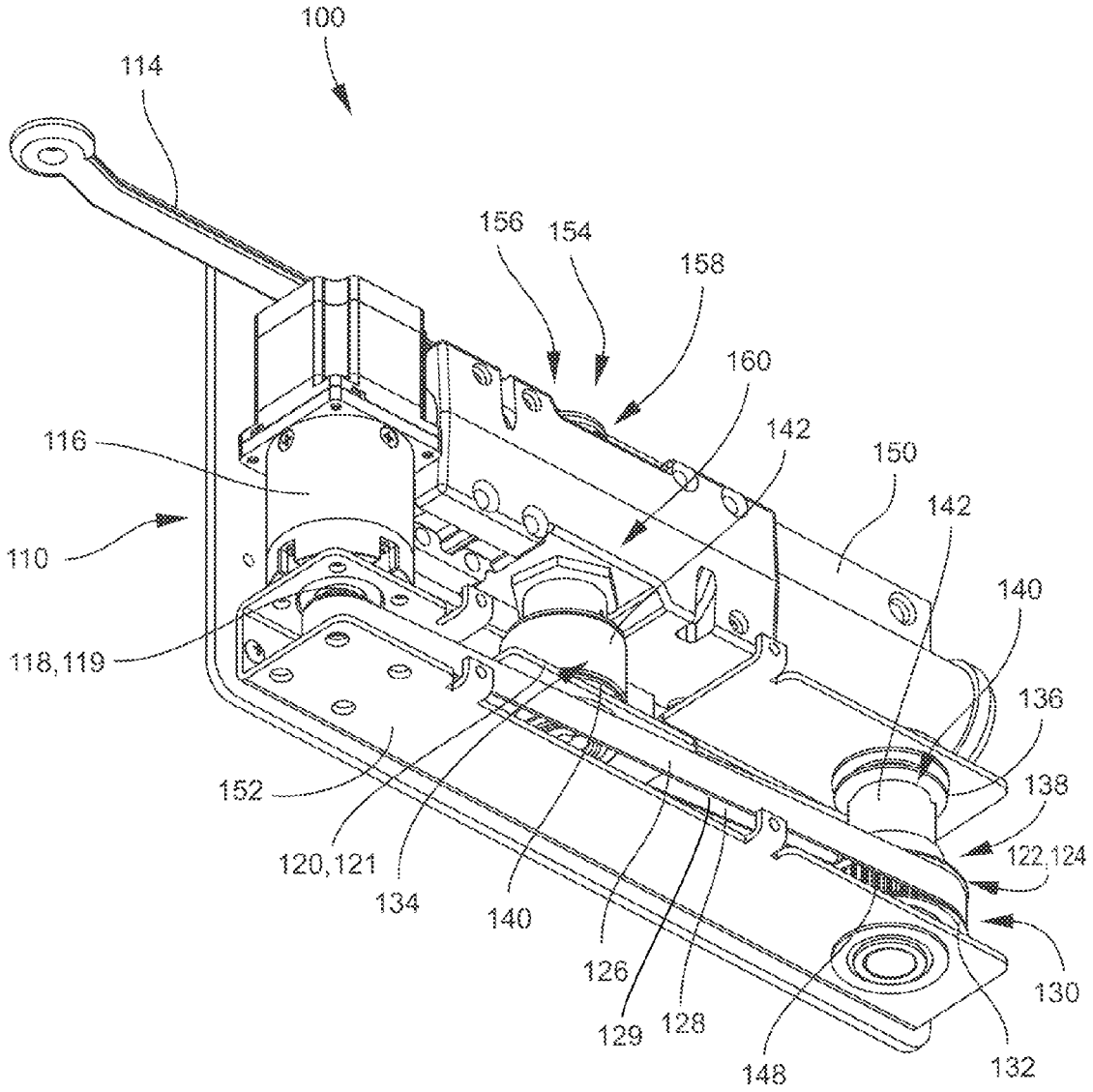
FIG. 5 is another front perspective view of the door opener system of FIG. 1.
Figure 6:
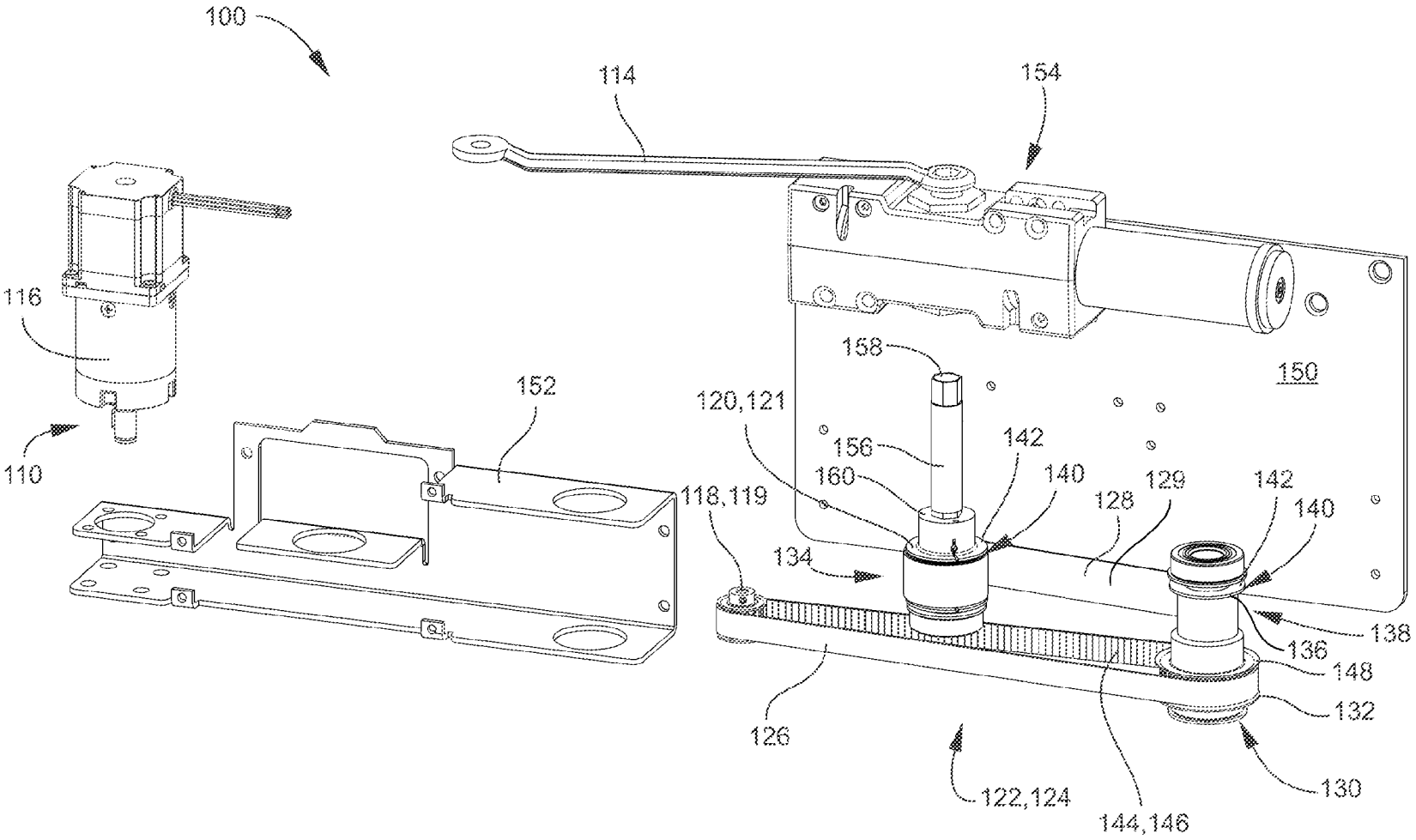
FIG. 6 is a partially disassembled front perspective view of the door opener system of FIG. 1.
Figure 7:
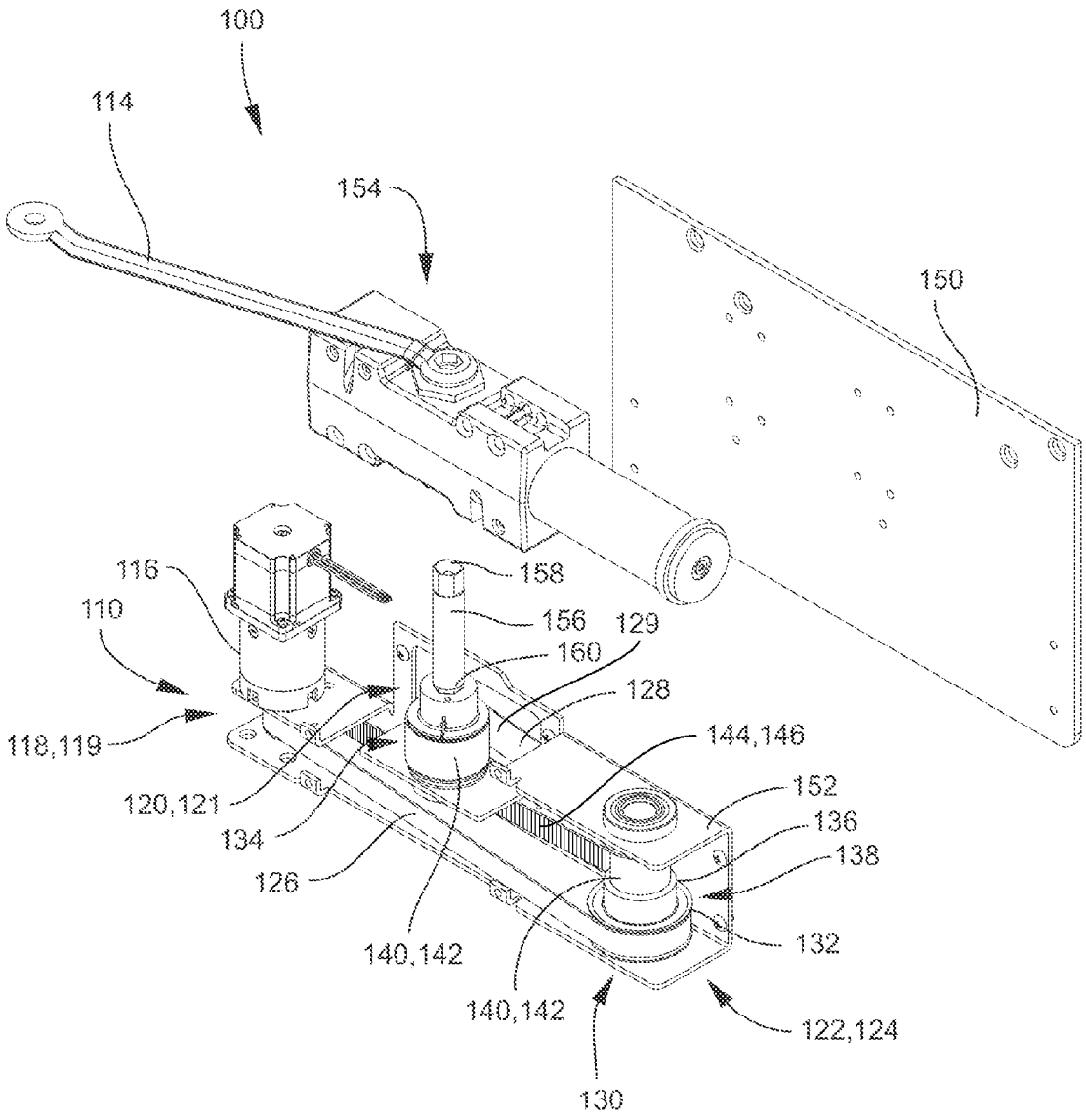
FIG. 7 is another partially disassembled front perspective view of the door opener system of FIG. 1.

It is to be noted that the drawings presented are intended solely for the purpose of illustration and that they are, therefore, neither desired nor intended to limit the disclosure to any or all of the exact details of construction shown, except insofar as they may be deemed essential to the claimed disclosure.

DETAILED DESCRIPTION

In describing the exemplary embodiments of the present disclosure, as illustrated in FIGS. 1-9, specific terminology is employed for the sake of clarity. The present disclosure, however, is not intended to be limited to the specific terminology so selected, and it is to be understood that each specific element includes all technical equivalents that operate in a similar manner to accomplish similar functions. Embodiments of the claims may, however, be embodied in many different forms and should not be construed to be limited to the embodiments set forth herein. The examples set forth herein are non-limiting examples, and are merely examples among other possible examples.

Referring now to FIGS. 1-8 by way of example, and not limitation, therein is illustrated an example embodiment of door opener system 100 with line belt driven retrofittable door opener 110, which may be referred to hereinafter as just door opener 110. Door opener 110 may be for automatically opening door 112 with arm 114. Door opener 110 may generally include motor 116, drive link 118, output link 120, and at least one flexible link 122, that may include at least one flexible line link 124.

Door 112 may be any door commonly known or developed in the future. As shown in the FIGS., in select embodiments, door 112 may be a standard swing door or gate. However, the invention is not so limited, and door opener system 100 with door opener 110 may be used on any door, gate, the like, or other similar device.

Motor 116 may be for powering the movement of drive link 118 connected to motor 116. Motor 116 may be any type or size motor for powering the movement of drive link 118. As shown in the FIGS., motor 116 may provide rotary motion for rotating drive link 118, thereby rotating belt loop 126 and/or pulling line belt 128. However, the invention is not so limited, and motor 116 may provide any type of motion for driving drive link 118. For example, motor 116 may provide linear motion (linear actuator, hydraulic cylinder, etc.), like for pulling line belt 128.

Output link 120 may be connected to arm 114 of door 112. Output link 120 may be for outputting the movement from motor 116 to arm 114. The at least one flexible link 122 may interconnect drive link 118 with output link 120. Wherein, motor 116 may be configured for opening door 112 by rotating drive link 118, which in turn may rotate output link 120 via the at least one flexible link 122, which in turn rotates arm 114, thereby opening door 112.

The at least one flexible link 122 may be included for interconnecting drive link 118 with output link 120. See FIGS. 1-8. Flexible link 122 may refer herein to any link between drive link 118 and output link 120 that is flexible or not substantially rigid. Flexible link 122 may include any flexible linking materials, including, but not limited to, a rubber belt, a urethane belt, a flexible steel belt, a flexible rope, a flexible chain, other like flexible link materials, and/or combinations thereof. As such, flexible link 122 may allow for some flexibility in the operation of door opener 110, thereby prolonging the life of door opener 110 and its parts (like transmissions or the like). In addition, the at least one flexible link 122 may be configured to compress and/or stretch to create a shock absorbing action. The at least one flexible link 122 may also be configured to allow manual opening of door 112, including, but not limited to, allowing manual opening of door 112 without rotating motor 116.

Figure 8:
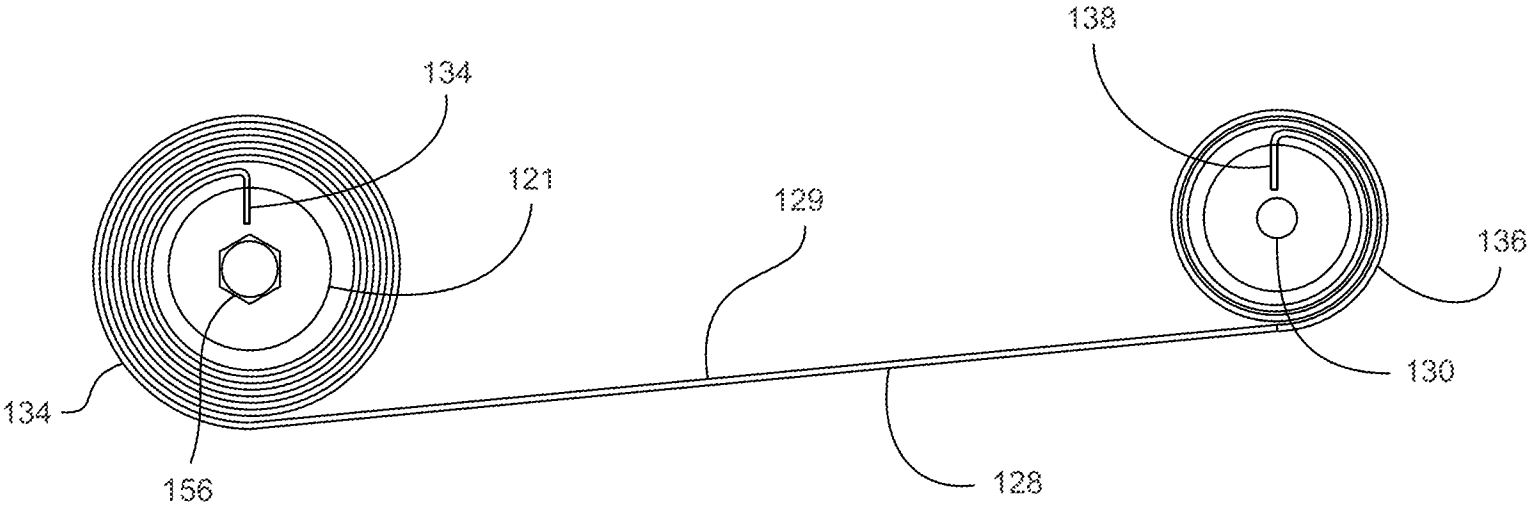
FIG. 8 is a cross-sectional view of the line belt wrapped around the output pulley and differential pulley.

In select embodiments, as shown in FIGS. 1-8 (best shown in FIG. 8) the at least one flexible link 122 may include at least one flexible line link 124. Flexible line link 124 or a plurality of flexible line links 124 may interconnect drive link 118 with output link 120 and may provide for some flexibility in the operation of door opener 110, thereby prolonging the life of door opener 110 and its parts. Flexible line link 124 may be any type of flexible line or belt, including, but not limited to a rubber flexible belt, a urethane flexible belt, a flexible steel belt, other like flexible belts, or combinations thereof. As discussed above, flexible line link 124 may provide for some flexibility in the operation of door opener 110, thereby prolonging the life of door opener 110 and its parts. In addition, the at least one flexible line link 124 may be configured to compress and/or stretch to create a shock absorbing action. The at least one flexible line link 124 may also be configured to allow manual opening of door 112, including, but not limited to, allowing manual opening of door 112 without rotating motor 116. In select embodiments of flexible line link 124, as shown in FIG. 8, flexible line link 124 may be configured to allow manual opening of the door 112 by allowing rotation pinion 156 to rotate freely in the opening direction, whereby flexible line link 124 merely uncoils around output link 120. In select other embodiments, as also shown in FIG. 8, flexible line link 124 may be configured to provide an automatic variable pulley ratio. In this automatic variable pulley ration embodiment, flexible line link 124 (i.e. line belt 128) may have a larger number of wraps on output pulley 121 as compared to second wheel 136 of differential pulley 130. Thus, the variable ratio may be produced when differential pulley 130 is rotated, whereby the wraps will increase on second wheel 136 thereby increasing its overall diameter at the same time the wraps of line belt 128 are pulled off unwrapping output pulley 121 decreasing its overall diameter.

As shown in FIGS. 1-8, in select embodiments, the at least one flexible link 122 may include loop belt 126 and line belt 128. Loop belt 126 and line belt 128 may be for providing a flexible link between drive link 118 and output link 120. In these loop and line belt embodiments, door opener 110 may further include differential pulley 130. Differential pulley 130 may interconnect loop belt 126 with line belt 128. Also in these embodiments, drive link 118 may be drive pulley 119 and output link 120 may be output pulley 121. Wherein, as shown, loop belt 126 may be looped around drive pulley 119 (connected to motor 116) and first wheel 132 of differential pulley 130. Line belt 128 may be wound around output pulley 121 at one end 134 and wound around second wheel 136 of differential pulley 130 at its other end 138. First wheel 132 and second wheel 136 of differential pulley 130 may be rotationally fixed, whereby rotation of first wheel 132 cause rotation of second wheel 136, and vice versa. In this configuration, motor 116 may be configured for opening door 112 by rotating drive pulley 119, which in turn may rotate differential pulley 130 via loop belt 126, which in turn may rotate output pulley 121 via line belt 128, which in turn may rotate arm 114, thereby opening door 112. In addition, with this configuration, line belt 128 may be configured to allow manual opening of door 112 without rotating motor 116, whereby, when door 112 is manually opened and arm 114 rotates output pulley 121, line belt 128 may be configured to uncoil (i.e. unwrap), thereby just creating slack in line belt 128. As such, when door 112 is manually opened the only movement in door opener 110 may be the rotation of output pulley 121 which merely uncoils or unwraps the layers of line belt 128 wrapped around output pulley 121 causing slack in line belt 128. When door 112 is then shut, output pulley 121 may rotate in the opposite direction, thereby causing line belt 128 to rewrap or recoil around output pulley 121. To facilitate this wrapping and unwrapping, or coiling and uncoiling, anti-stick material 140 may be included between wound layers 142 of line belt 128. Anti-stick material 140 may be configured for preventing wound layers 142 from sticking. Anti-stick material 140 may be any anti-stick material configured for preventing wound layers 142 from sticking. The Anti-stick material 140 may be a compressive material. The Anti-stick material 140 may be configured to create a shock absorbing action. This configuration of door opener 110 and door opener system 100 may provide a flexible long lasting operator that necessitates little to no additional opening force for manual operation of door 112.

In select embodiments, door opener 110 may include a sensor or plurality of sensors. The sensor or plurality of sensors may be for sensing the movement of door opener system 100 and controlling motor 116 based on the sensed motion. In select embodiments, the sensors may be associated with flexible link 122, like line belt 128. The sensors may be for sensing the movement of flexible link 122, like line belt 128. This sensed movement may then be utilized for controlling motor 116. In select embodiments, door opener 110 may include a first sensor on or associated with first end 134, like on or around output pulley 121, and a second sensor on or associated with second end 138, like on or around second wheel 136 of differential pulley 130. The combination of these first and second sensors may sense the movement of line belt 128 and determine the associated variable pulley ratio for controlling motor 116.

Inner surface 144 of loop belt 126 may be configured to grip drive pulley 119 and first wheel 132 of differential pulley 130. Inner surface 144 along with drive pulley 119 and first wheel 132 may have any configuration for grip, including any corresponding shapes. Referring specifically to FIGS. 4-7, in select embodiments of door opener 110, inner surface 144 may include teeth 146 configured to grip grooves 148 on drive pulley 119 and first wheel 132 of differential pulley 130.

Inner surface 129 of line belt 128 may be configured to grip drive pulley 121 and second wheel 136 of differential pulley 130. See FIGS. 1-8. Inner surface 129 of line belt 128 along with drive pulley 121 and second wheel 136 may have any configuration for attaching ends of 134 and 138 of line belt 128 including but not limited to, adhesive, welding, locking groove of corresponding shapes, or mechanical clamping forces.

Door opener 110 may be configured with various size and shapes of flexible links 122 including various size and shapes of loop belt 126 and line belt 128. The size and shapes of flexible links 122, including loop belt 126 and line belt 128 may be designed based on the size and weight of door 112, various designs of arm 114, various size and powers of motor 116, various desired speeds of opening and/or closing door 112, etc. In addition, drive link 118 and output link 120 may correspondingly be designed for such size and shapes of flexible link 122. In select embodiments, as shown in FIGS. 1-7, drive pulley 119 may be smaller than output pulley 121, thereby providing added power or outputted movement from motor 116 to arm 114. Similarly, drive pulley 119 may be smaller than first wheel 132 of differential pulley 130, first wheel 132 of differential pulley 130 may be larger than second wheel 136 of differential pulley 130, second wheel 136 of differential pulley 130 may be smaller than output pulley 121, the like, and/or combinations thereof. In addition, in select embodiments, line belt 128 may be configured to provide an automatic variable pulley ratio. In this automatic variable pulley ration embodiment, line belt 128 may have a larger number of wraps on output pulley 121 as compared to second wheel 136. Thus, the variable ratio may be produced when differential pulley 130 is rotated, whereby the wraps will increase on second wheel 136 thereby increasing its overall diameter at the same time the wraps of line belt 128 are pulled off unwrapping output pulley 121 decreasing its overall diameter.

Back plate 150 may be included with door opener system 100. Back plate 150 may be configured for mounting door opener system 100 to door 112. Back plate 150 may be configured to mount door opener 110 to door 112 by itself or with existing door closer 154, as shown in the figures.

Inner bracket assembly 152 may be included with door opener 110. Inner bracket assembly 152 may be configured to at least position or house motor 116, drive link 118 and output link 120 in door opener 110. Inner bracket assembly 152 may also position or house all of the parts of door opener 110 as shown and/or described herein.

Still referring to FIGS. 1-8, door opener 110 may be configured to be retrofitted to existing door closer 154. Existing door closer 154, or just door closer 154, may be any door closer known or later developed. In general, existing door closer 154 may include a force, like via a piston, cylinder, etc., and rotating pinion 156 linked to such a force, for outputting the force to arm 114. As such, door closer 154 may generally allow free rotation of rotating pinion 156 in the opening direction of door 112 and may provide a controlled rotation force in the opposite direction for closing door 112 in a controlled motion via the force on rotating pinion 156. As such, door opener 110 may be configured to link to rotating pinion 156, whereby, door opener 110 may provide the force for opening door 112 and door closer 154 may provide the force for controlling the closing of door 112. In select embodiments, retrofitted, may refer herein, to the capability of adding door opener 110 to existing door closer 154 without having to modify existing door closer 154. As such, in select embodiments, no holes need to be made or drilled in existing door closer 154, no change to the internals or mechanics of existing door closer 154 need to be made (i.e. power settings, etc.), the like, and/or combinations thereof.

As shown FIGS. 1-8, output link 120 may be configured to attach with rotating pinion 156 of existing door closer 154 for connecting door opener 110 with existing door closer 154. In select embodiments, output link 120 may be designed or configured to accept the shape of rotating pinion 156, like including an octagonal hole for accepting the octagonal end of rotating pinion 156. As such, rotation of rotating pinion 156 forces rotation of output link 120 and vice versa. Whereby, door opener 110 may open door 112 by rotating output link 120, which in turn may rotate rotating pinion 156 of existing door closer 154, which in turn may rotate arm 114, thereby opening door 112. In addition, when the door is opened (whether manually or automatically with door opener 110), existing door closer 154 may control the closing motion of door 112 via the force on rotating pinion 156. In these embodiments, back plate 150 may be configured to mount both existing door closer 154 and door opener 110 to door 112.

In select embodiments, the existing door closer 154 may be non-handed (i.e. it can work on a left or right opening door) via rotating pinion 156 extending through existing door closer 154 on both ends 158 and 160. In these embodiments, when existing door closer 154 is mounted on door 112 with arm 114 connected to one end 158 of rotating pinion 156, output link 120 or output pulley 121 of door opener 110 may be configured to attach to the unused end 160 of rotating pinion 156.

Although not shown in the figures, door opener 110 may operate alone, i.e. without door closer 154 or any other devices, or be configured to mount directly to arm 114. As such, output link 120 may be configured to attach directly to arm 114 whereby rotation of output pulley 121 cause rotation of arm 114 and vice versa. In select embodiments, door opener 110 may be configured to provide movement for the opening and closing of door 112.

In addition, although the instant disclosure is directed to retrofitting existing door closer 154 with door opener 110, door opener system 100 may also be designed for automatically opening and controlling the closing of door 112 with arm 114, i.e. door system 100 may be designed with both door opener 110 and door closer 154 pre-assembled and/or packaged together as a single unit to be installed on any door 112. As such, in select embodiments, door opener system 100 may include door opener 110 in any of the various embodiments shown and/or described herein including at least motor 116 with output link 120, and door closer 154 including at least rotating pinion 156. Wherein, output link 120 of door opener 110 may be attached with rotating pinion 156 of door closer 154. Whereby door opener system 100 may open door 112 by rotating output link 120 via motor 116 of door opener 110, which in turn may rotate rotating pinion 156 of door closer 154, which in turn may rotate arm 114, thereby opening door 112. Also, when door 112 is opened (either manually or via door opener system 100), door closer 154 may control the closing of door 112 via the force on rotating pinion 156.

Figure 9:
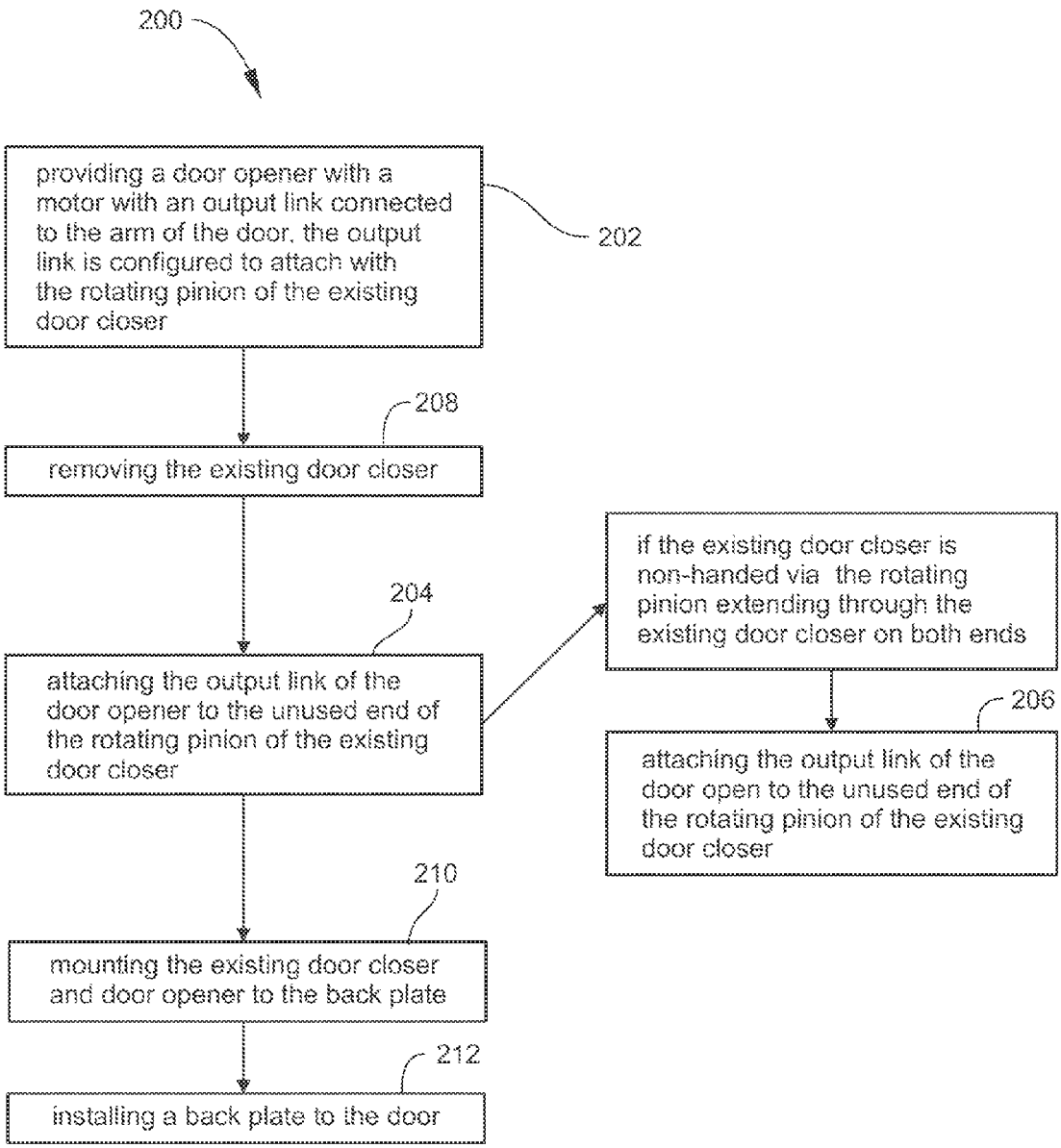
FIG. 9 is a flow chart of the method of retrofitting a door opener to an existing door closer with a rotating pinion according to select embodiments of the instant disclosure.

Referring now to FIG. 9, in use, method 200 of retrofitting door opener 110 to existing door closer 154 may be carried out using any of the various embodiments of door opener 110 as shown and/or described herein. Method 200 may be for retrofitting door opener 110 to attach to rotating pinion 156 of existing door closer 154 to create door opener system 100. Method 200 of retrofitting door opener 110 to existing door closer 154 may generally include the steps of: step 202 of providing door opener 110 in any of the various embodiments as shown and/or described herein, including at least motor 116 with output link 120; and step 204 of attaching output link 120 of door opener 110 with rotating pinion 156 of existing door closer 154.

In select embodiments of method 200 of retrofitting door opener 110 to existing door closer 154, wherein existing door closer 154 is non-handed (i.e. can be used on a left or right opening door) via rotating pinion 156 extending through existing door closer 154 on both ends 158 and 160, step 204 of attaching output link 120 of door opener 110 with rotating pinion 156 of existing door closer 154 may include attaching output link 120 of door opener 110 to the unused end 160 of rotating pinion 156 of existing door closer 154.

In other select embodiments of method 200 of retrofitting door opener 110 to an existing door closer 154, method 200 may further include the steps of: step 208 of removing existing door closer 154; step 210 of mounting existing door closer 154 and door opener 110 to back plate 150; and step 212 of connecting back plate 150 to door 112.

In other select embodiments of method 200 of retrofitting door opener 110 to existing door closer 154, method 200 may include a process of retrofitting without having to modify existing door closer 154. As such, in select embodiments, no holes need to be made or drilled, no change to the internals or mechanics of existing door closer 154 need to be made (i.e. power settings, etc.), the like, and/or combinations thereof.

The foregoing description and drawings comprise illustrative embodiments. Having thus described exemplary embodiments, it should be noted by those skilled in the art that the within disclosures are exemplary only, and that various other alternatives, adaptations, and modifications may be made within the scope of the present disclosure. Merely listing or numbering the steps of a method in a certain order does not constitute any limitation on the order of the steps of that method. Many modifications and other embodiments will come to mind to one skilled in the art to which this disclosure pertains having the benefit of the teachings presented in the foregoing descriptions and the associated drawings. Although specific terms may be employed herein, they are used in a generic and descriptive sense only and not for purposes of limitation. Accordingly, the present disclosure is not limited to the specific embodiments illustrated herein, but is limited only by the following claims.

What is claimed is:

1. A door opener for automatically opening a door with an arm comprising a motor;

a drive link connected to said motor;

an output link connected to the arm of the door; and at least one flexible link interconnecting said drive link with said output link;

said at least one flexible link including at least one flexible line link;

wherein:

said at least one flexible link is configured to compress, and stretch to create a shock absorbing action;

said at least one flexible link is configured to allow manual opening of the door; and said at least one flexible link is configured to allow manual opening of the door without rotating the motor.

2. The door opener of claim 1 wherein, said motor is configured for opening the door by rotating the drive link, which in turn rotates the output link via the at least one flexible link, which in turn rotates the arm, thereby opening the door.

3. The door opener of claim 1, wherein said at least one flexible link includes a loop belt and a line belt.

4. The door opener of claim 3 further comprising:

a differential pulley interconnecting said loop belt with said line belt;

said drive link is a drive pulley and said output link is an output pulley;

said loop belt is looped around said drive pulley connected to the motor and a first wheel of said differential pulley, where an inner surface of the loop belt includes teeth configured to grip grooves on said drive pulley and the first wheel of said differential pulley; and said line belt is wound around said output pulley at one end and wound around a second wheel of said differential pulley at its other end, thereby creating an automatic variable pulley ratio, where the line belt includes an anti-stick material between wound layers configured for preventing the wound layers from sticking;

said first wheel and said second wheel of said differential pulley being rotationally fixed; and said motor is configured for opening the door by rotating the drive pulley, which in turn rotates the differential pulley via the loop belt, which in turn rotates the output pulley via the line belt, which in turn rotates the arm, thereby opening the door;

wherein the line belt is configured to allow manual opening of the door without rotating the motor;

whereby, when the door is manually opened and the arm rotates the output pulley, the line belt is configured to uncoil.

5. The door opener of claim 4, wherein:

said drive pulley is smaller than said output pulley;

said drive pulley is smaller than said first wheel of said differential pulley;

said first wheel of said differential pulley is larger than said second wheel of said differential pulley;

said second wheel of said differential pulley is smaller than said output pulley.

6. The door opener of claim 1 further including:

a back plate configured for mounting the door opener to the door; and an inner bracket assembly configured to at least position the motor, the drive link and the output link.

7. The door opener of claim 1 being configured to be retrofitted to an existing door closer without having to modify the existing door closer.

8. The door opener of claim 7, wherein said output link is attached to the arm of the door via a rotating pinion of the existing door closer;

whereby the door opener opens the door by rotating the output link, which in turn rotates the rotating pinion of the existing door closer, which in turn rotates the arm, thereby opening the door; and whereby, when the door is opened, the existing door closer controls the closing of the door via the rotating pinion.

9. The door opener of claim 8, wherein the existing door closer is non-handed via the rotating pinion extending through the existing door closer on both ends;

whereby, when the existing door closer is mounted on the door with the arm connected to one end of the rotating pinion, the output link of the door opener is configured to attach to an unused end of the rotating pinion.

10. The door opener of claim 1, wherein the door is a swing door or gate, whereby the door opener is configured to operate the swing door or gate.

11. The door opener of claim 1 wherein:

said flexible link is a line belt;

said drive link is a drive pulley and said output link is an output pulley;

said line belt is attached to the drive pulley and the output pulley;

said line belt is wrapped upon it self;

said line belt is configured to wrap or unwrap to produce a variable ratio.

12. The door opener of claim 1 wherein:

said flexible link is a line belt;

said drive link is a drive pulley and said output link is an output pulley;

said line belt is attached to the drive pulley and the output pulley;

said line belt is wound around said output pulley at one end and wound around the drive pulley at its other end;

said motor is configured for opening the door by rotating the drive pulley, which in turn rotates the output pulley via the line belt, which in turn rotates the arm, thereby opening the door;

wherein the line belt is configured to allow manual opening of the door without rotating the motor;

whereby, when the door is manually opened and the arm rotates the output pulley, the line belt is configured to uncoil.

13. The door opener of claim 1 wherein:

said flexible link is a line belt;

said line belt is fitted with sensors on each end of the line belt that sense each end of the line belt independently;

wherein, the sensors control the line belt slack.

14. A door opener for automatically opening a door with an arm and an existing door closer linked to said arm via a rotating pinion comprising:

a motor with an output link connected to the arm of the door via the rotating pinion of the door closer;

a drive link connected to said motor; and at least one flexible link interconnecting said drive link with said output link;

said at least one flexible link including at least one flexible line link;

wherein, said motor is configured for opening the door by rotating the drive link, which in turn rotates the output link via the at least one flexible link, which in turn rotates the arm, thereby opening the door.

15. The door opener of claim 14, whereby the door opener opens the door by rotating the output link, which in turn rotates the rotating pinion of the existing door closer, which in turn rotates the arm, thereby opening the door; and whereby, when the door is opened, the existing door closer controls the closing of the door via the rotating pinion.

16. The door opener of claim 14, wherein the existing door closer is non-handed via the rotating pinion extending through the existing door closer on both ends;

whereby, when the existing door closer is mounted on the door with the arm connected to one end of the rotating pinion, the output link of the door opener is configured to attach to an unused end of the rotating pinion.

17. The door opener of claim 14, wherein said at least one flexible link is configured to allow manual opening of the door without rotating the motor.

18. A door opener system for automatically opening and controlling the closing of a door with an arm comprising:

a door opener comprising a motor with an output link connected to the arm of the door;

an existing door closer comprising a rotating pinion;

wherein, said output link of the door opener is attached to the arm of the door via the rotating pinion of the door closer;

a drive link connected to said motor; and at least one flexible link interconnecting said drive link with said output link;

said at least one flexible link including at least one flexible line link;

wherein, said motor is configured for opening the door by rotating the drive link, which in turn rotates the output link via the at least one flexible link, which in turn rotates the rotating pinion of the door closer, which in turn rotates the arm, thereby opening the door.

19. The door opener system of claim 18, whereby the door opener opens the door by rotating the output link, which in turn rotates the rotating pinion of the door closer, which in turn rotates the arm, thereby opening the door; and whereby, when the door is opened, the door closer controls the closing of the door via the rotating pinion.

20. The door opener system of claim 18, wherein the door closer is non-handed via the rotating pinion extending through the door closer on both ends;

whereby, when the door closer is mounted on the door with the arm connected to one end of the rotating pinion, the output link of the door opener is attached to an unused end of the rotating pinion.

21. The door opener system of claim 18 further including:

a back plate configured for mounting the door closer and door opener to the door.

22. A method of retrofitting a door opener to an existing door closer with a rotating pinion comprising:

providing a door opener comprising:

a motor;

a drive link connected to said motor;

an output link connected to the arm of the door; and at least one flexible link interconnecting said drive link with said output link;

said at least one flexible link including at least one flexible line link;

wherein:

said at least one flexible link is configured to compress, and stretch to create a shock absorbing action;

said at least one flexible link is configured to allow manual opening of the door; and said at least one flexible link is configured to allow manual opening of the door without rotating the motor; and attaching the output link of the door opener with the rotating pinion of the existing door closer.

23. The method of claim 22, wherein the existing door closer is non-handed via the rotating pinion extending through the existing door closer on both ends;

wherein, the step of attaching the output link of the door opener with the rotating pinion of the existing door closer including:

attaching the output link of the door opener to an unused end of the rotating pinion of the existing door closer.

24. The method of claim 22 further comprising the steps of:

removing the existing door closer;

mounting the existing door closer and the door opener to a back plate; and connecting the back plate to the door.

25. The method of claim 22 wherein the method includes no required steps for modifying the existing door closer.

* * * * *